US007246705B2

(12) United States Patent
Kaltz, Jr. et al.

(10) Patent No.: US 7,246,705 B2
(45) **Date of Patent: *Jul. 24, 2007**

(54) SHIPPING CONTAINER AND DUNNAGE THEREFOR

(75) Inventors: Thomas Richard Kaltz, Jr., Warren, MI (US); Donna Lou Lucas, River Rouge, MI (US)

(73) Assignee: Carroll Packaging, Dearborn, MI (US)

( * ) Notice: Subject to any disclaimer, the term of this patent is extended or adjusted under 35 U.S.C. 154(b) by 509 days.

This patent is subject to a terminal disclaimer.

(21) Appl. No.: 10/843,055

(22) Filed: May 10, 2004

(65) Prior Publication Data

US 2005/0011801 A1 Jan. 20, 2005

Related U.S. Application Data

(63) Continuation-in-part of application No. 10/619,666, filed on Jul. 15, 2003, now Pat. No. 6,896,142.

(51) Int. Cl.
*B65D 85/30* (2006.01)

(52) U.S. Cl. ..... 206/589; 206/585; 206/521; 206/593

(58) Field of Classification Search ..... 206/448, 206/453, 586, 600, 585, 521, 593, 589; 220/4.28, 220/4.31
See application file for complete search history.

(56) References Cited

U.S. PATENT DOCUMENTS

| | | | |
|---|---|---|---|
| 2,539,372 | A | 1/1951 | Metzler |
| 2,844,268 | A | 1/1952 | Lambert |
| 2,879,886 | A | 3/1959 | Crane |
| 3,043,488 | A | 7/1962 | Warwick |
| 3,259,003 | A | 7/1966 | Griffin |
| 3,311,232 | A | 3/1967 | Howell |
| 3,344,916 | A | 10/1967 | Brueckner |
| 3,714,310 | A | 1/1973 | Gaffney et al. |
| 3,771,646 | A | 11/1973 | Mascetti, Jr. |
| 3,790,652 | A | 2/1974 | Colijn et al. |
| 3,872,194 | A | 3/1975 | Lowry et al. |
| 3,924,738 | A | 12/1975 | Poupitch |
| 3,932,569 | A | 1/1976 | Fuss |
| 3,935,357 | A | 1/1976 | Padovani |
| 4,007,538 | A | 2/1977 | Petrie |
| 4,030,039 | A | 6/1977 | Fahlgren |

(Continued)

FOREIGN PATENT DOCUMENTS

| | | |
|---|---|---|
| JP | 5548978 | 12/1980 |

*Primary Examiner*—David T. Fidei
(74) *Attorney, Agent, or Firm*—Brooks Kushman P.C.

(57) ABSTRACT

Dunnage for supporting elongated products arranged in layers in storage or shipping containers comprises elongated plastic strips having openings for receiving the goods and also having reinforcing members extending along their undersides which are removably received in dunnage supports attached to the sides of the container. The dunnage supports are so arranged that the reinforcing members are supported out of contact with subjacent and superjacent layers of the products and dunnage. For returnable containers or boxes whose walls are collapsed inwardly over the floor of the box, space may be provided beneath the inwardly folded walls to accommodate the dunnage for return shipment. Wall brackets for supporting opposite ends of the dunnage strips may be shallow and the dunnage provided with flanges for reception between the box walls and the brackets thereby permitting use of shallow brackets allowing the box walls to be folded in bypass relation thereto.

12 Claims, 6 Drawing Sheets

U.S. PATENT DOCUMENTS 4,030,392 A 6/1977 Torres
4,112,810 A 9/1978 Dreibelbis
4,182,450 A * 1/1980 Kryger ..... 206/448
4,261,940 A 4/1981 Bussey, Jr.
4,349,109 A 9/1982 Scordato et al.
4,501,355 A 2/1985 Hoffman
4,566,831 A 1/1986 Groth
4,643,310 A 2/1987 Deaton et al.
4,763,782 A * 8/1988 Sinchok ..... 206/708
4,850,256 A 7/1989 Radi
4,879,932 A 11/1989 Scalise et al.
4,921,101 A 5/1990 Gatt
4,930,384 A 6/1990 Nakatsuji
4,979,620 A 12/1990 Delamare et al.
5,005,458 A 4/1991 Merrick
5,178,279 A 1/1993 Carroll
5,267,652 A 12/1993 Carroll
5,306,455 A 4/1994 Carroll
5,339,958 A * 8/1994 Taravella et al. ..... 206/521
5,509,534 A * 4/1996 Taravella et al. ..... 206/587
6,598,756 B1 * 7/2003 Rosenfeldt ..... 220/4.28

* cited by examiner

SHIPPING CONTAINER AND DUNNAGE THEREFOR

CROSS-REFERENCE TO RELATED APPLICATIONS

This application is a continuation-in-part of U.S. application Ser. No. 10/619,666, filed Jul. 15, 2003 now U.S. Pat. No. 6,896,142.

BACKGROUND OF THE INVENTION

1. Field of the Invention

This invention relates to dunnage and to a method for packaging layers of products in a container without the weight of superjacent products resting or bearing on subjacent products and wherein the products may be readily removed from the container until it is empty, and wherein the empty container with or without the dunnage may returned to the sender for re-use.

2. Background Art

In U.S. Pat. Nos. 5,267,652 and 5,178,279, incorporated herein by reference, dunnage is disclosed for supporting automotive parts or the like for shipment and storage pending use on an assembly line. It is intended that boxes containing the parts, which are supported in the dunnage, are placed adjacent the automotive assembly line, and as vehicles move down the line, the parts are removed from the boxes and placed in or on the vehicle. The dunnage may comprise elongated strips of polyethylene, polystyrene or the like having transverse slots or notches shaped to allow the parts to nestle therein so they do not rub against adjacent parts. This arrangement has been quite satisfactory.

In U.S. Pat. No. 5,267,652, the dunnage for one layer of products rests or bears on surfaces of the products of the subjacent layer, and when such surfaces are the Class A surfaces may result in marring the same. In such cases it is desirable to store the parts in layers in the boxes in such fashion that the superjacent dunnage is spaced from the Class A surfaces of the subjacent parts. On occasion this may be accomplished by designing the dunnage to have upstanding posts, such as shown in U.S. Pat. No. 5,178,279, where upstanding posts serve to hold superjacent dunnage out of contact with Class A surfaces of a subjacent layer.

In some instances the shape of the parts is such that the dunnage disclosed in the '652 patent or the '279 patent cannot be configured in themselves to avoid the dunnage of a superjacent layer from resting on or contacting the Class A surfaces of the parts in a subjacent layer or for any other reason the dunnage of such patents cannot hold the parts out of undesired contact either with other parts, or with the container in which the dunnage and parts are stored.

Recently, particularly in the automobile manufacturing industry, the practice had been growing of using reusable shipping containers or boxes which, after being emptied at the automobile manufacturer, are collapsible and are returned to the parts supplier for refilling and return shipment to the automobile manufacturer. It has therefore become desirable to utilize dunnage which may also be returnable and which can be returned to the parts supplier within the collapsed returning boxes.

Providing dunnage which is usable with collapsible boxes and which itself is returnable for reuse, has required several modifications in the design of the dunnage while still using several of the basic features as described in the parent application as originally filed.

SUMMARY OF THE INVENTION

The elongated strips of dunnage shown in U.S. Pat. Nos. 5,267,652 or 5,178,279 have proven to be highly desirable for keeping layers of products in a shipping or storage container separated and avoid marring of class A surfaces. However, as mentioned above, the products may not lend themselves to having the weight of a superjacent layer of dunnage and product rest upon the subjacent layer of product or dunnage. In such instances, we have found that the dunnage may nevertheless be used if it is supported out of contact with the product or dunnage in a subjacent layer of dunnage. The dunnage shown in U.S. Pat. Nos. 5,267,652 or 5,178,279 is not in itself strong enough to prevent collapse if the dunnage is supported only at its ends. But, we have discovered that if each dunnage strip is supported from beneath and throughout its length by a reinforcing member with opposite ends of the reinforcing member received in pockets or the like on the walls of the shipping or storage container, the dunnage may be used with good results.

Accordingly, we disclose dunnage strips which have a soft or resilient upper portion with upwardly opening product receiving openings and a rigid lower reinforcing portion, or member, secured to the underside of the resilient soft upper portion and supporting it throughout their length. Ends of the reinforcing member are removably disposed in pockets secured to or disposed within the walls of the box or other container within which the goods are housed. The reinforcing members are removably received in the pockets such that as the product is removed from the box, the dunnage may similarly be easily removed simply by lifting it out of the pockets thereby to gain access to a subjacent layer of product. In one form of the reinforcing member, it is formed of a corrugated plastic panel scored and folded upon itself in a triangular shape, and the pockets into which the ends of the reinforcing members are received are of a similar V-shape. In another form of the reinforcing member, it is an extruded tube of any desired cross-sectional shape, such as square, and has sufficiently rigid walls that it will support the weight of the products nestled in the dunnage strip on top of it.

In order to make the dunnage usable with collapsible boxes, we have provided dunnage-supporting pockets for mounting on the walls of the box. In a preferred embodiment, the dunnage supporting pockets are sufficiently thin or shallow that they do not interfere with the collapsibility of the boxes. We accomplish this objective by modifying the ends of the dunnage to provide thin flanges for reception in the aforesaid thin pockets. We provide a shallow pocket design which is not appreciably greater than twice the thickness of the material from which the flanges are formed. This permits the collapsible walls of the box to be folded inwardly over the floor and between the box walls upon which the pockets are mounted, bypassing the pockets without interference.

The box or container walls may comprise upper and lower hingedly connected wall portions. The lower wall portion may be fixed and the upper wall portion hinged to it for folding inwardly over the floor, with the height of the fixed wall at the hinge being sufficiently high above the box floor as to create storage space for the dunnage between the inwardly swinging upper wall portion and the floor when the box is to be returned.

DETAILED DESCRIPTION OF THE PREFERRED EMBODIMENT(S)

Figure 1:
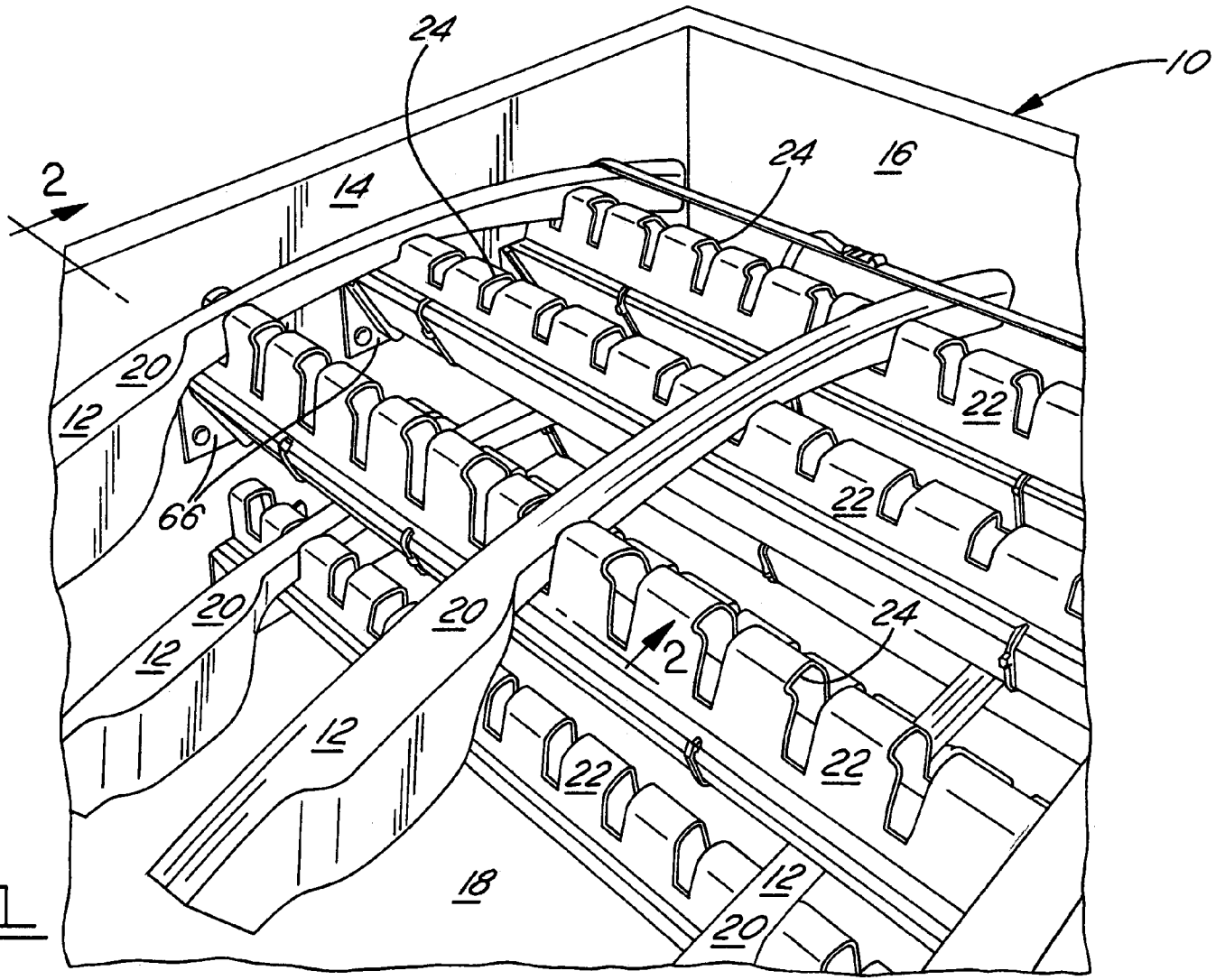
FIG. 1 is a fragmentary perspective of our improved dunnage in a shipping or storage container.

FIG. 1 is a fragmentary view of a corner of a shipping or storage container 10 (sometimes referred to herein as a box) for elongated products, a few of which are depicted at 12. The shipping or storage container is of conventional construction having four side walls 14 and 16 and opposite parallel walls not shown. Conventionally, the shipping or storage container will have a bottom wall 18 and may be open at the top. The container may be formed of any suitable material such as cardboard, plastic, metal or the like, depending upon the nature of the products being shipped and the conditions of shipment. In the present case, it is intended that the shipping or storage container be of a box-like construction with the end wall 16 and its opposite wall (not shown) being spaced apart at least the length of the product 12, and the dunnage supporting the product extending transversely of the product between the side wall 14 and its opposite wall (not shown). A principal use is in the automotive supply business in which shipping or storage containers are filled with products at an automotive supplier and then the container is shipped to the automotive assembly plant and placed adjacent the assembly line. As a vehicle on the line approaches the container, a workman may remove the products from the container and affix them to the vehicle. This is desirably accomplished by simply lifting the products vertically out of the box and placing them on or in the vehicle. When the top layer of products has been removed, it is desirable that the dunnage similarly be easily removed exposing the next subjacent layer of product for use.

The product contained within the box which is shown at 12 in FIG. 1 for purposes of illustration is assumed to have an upwardly facing Class A surface which must not be marred or disfigured during storage and shipment. Accordingly, superjacent layers of dunnage and product are not allowed to rest upon the Class A surfaces. Such surfaces are indicated by the reference numeral 20 in FIG. 1. The elongated products extend between the end wall 16 and its opposite wall (not shown) while the dunnage extends at substantially right angles to the product and extends between the side wall 14 and its opposite wall (not shown).

The dunnage comprises an upwardly facing product receiving and supporting strip in the form of an extruded plastic tube 22 and a downwardly facing rigidifying portion 34 (see FIG. 2) extending along beneath the tube to support the same against collapse and hold it out of contact with an underlying layer of the products. The extruded plastic tubes 22 are resilient and soft enough so that they do not mar other surfaces of the product, which may include Class A surfaces. The character of such tubing is disclosed in U.S. Pat. No. 5,267,652. Each tube has a series of cut-outs or openings 24 which are shaped and adapted to receive the products to be shipped or stored in the container. A cross-section of a typical tube is shown at 22 in FIG. 3. The tube has a crown portion 26, side walls 28 and 30 and a bottom wall 32. For more detail of the tubes, reference should be made to U.S. Pat. No. 5,267,652.

Figures 3, 4, 5:
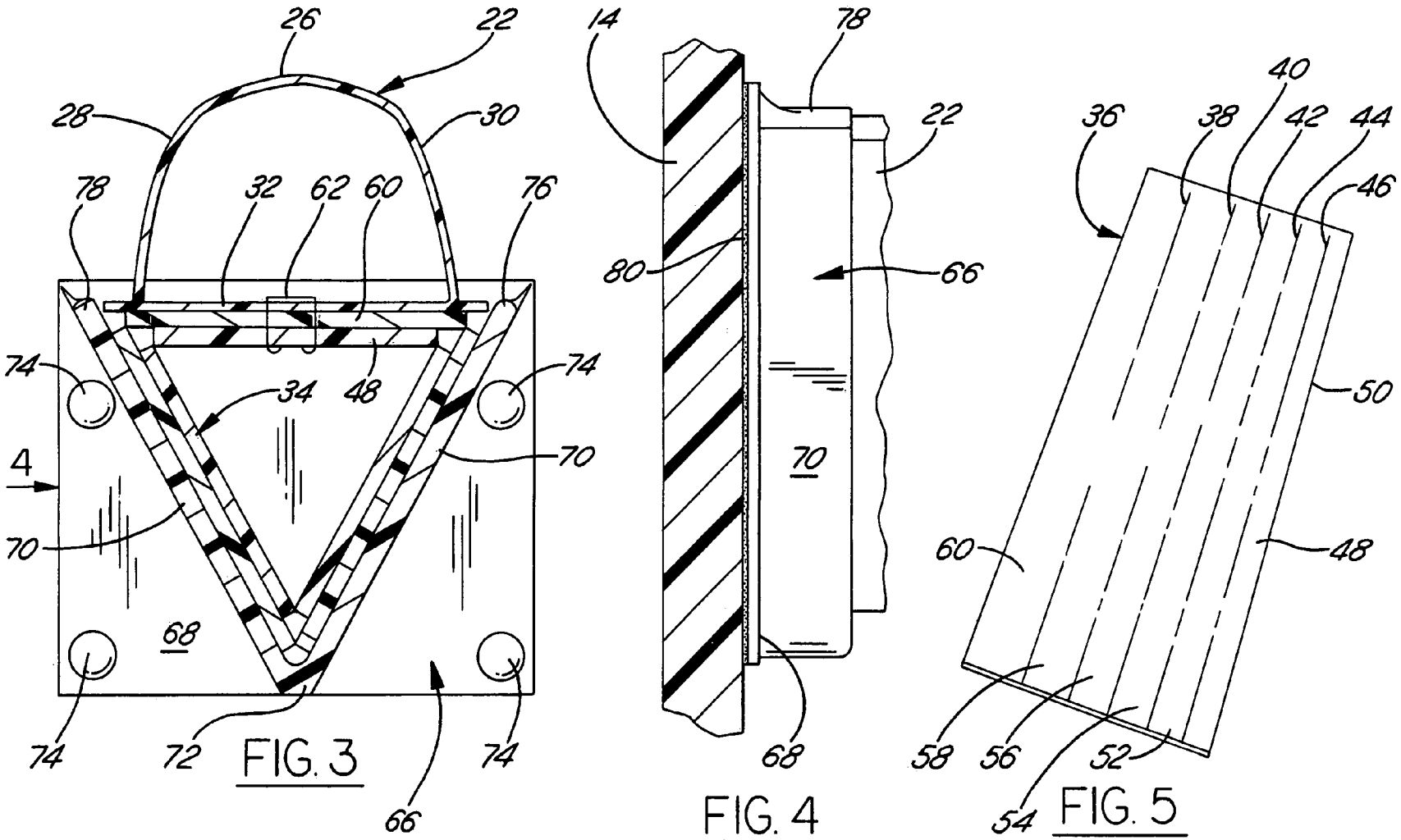
FIG. 3 is a cross-sectional view taken on line 3-3 of FIG. 2.
FIG. 4 is a side view of a dunnage support looking in the direction of arrow 4 of FIG. 3.
FIG. 5 is a plan view Of the plastic corrugated panel prior to folding into the reinforcing member.

To support the dunnage and prevent collapse when loaded with the products to be shipped or stored, and to hold it spaced out of contact with superjacent or subjacent layers of the product, reinforcing members 34 extend along the length of the tubes and in supporting abutment with the bottom wall 32 thereof as best shown in FIG. 3. Each reinforcing member is preferably formed from a relatively rigid corrugated-like sheet or panel 36 scored and then folded into triangular configuration as shown in FIG. 5. The panel 36 is sold under the name COR-X by several companies including Primax Plastics Corporation of Richmond, Va. The material used in manufacturing the panel may be either polypropylene or polyethylene. The scoring is indicated at 38, 40, 42, 44 and 46. The scoring enables the plastic sheet or panel to be folded into the triangular configuration shown in FIG. 3. The narrowest panel 48 defined by the score line 46 and the edge 50 of the sheet is depicted in FIG. 3. Other panels defined by the scoring of the sheet are depicted at 52, 54, 56, 58 and 60 in FIG. 5, and some of such panels are referenced in FIG. 3. The load bearing capacity of the reinforcing members 34 may be increased or reduced by the number of score lines and consequent number of laminations in the reinforcing members.

To secure the reinforcing member to the tube and also prevent the reinforcing member from delaminating, staples 62, one of which is shown in FIG. 3, may be driven through the several laminations or panels and also through the bottom wall 32 of the tube. This will serve to prevent delamination of the reinforcing member and also hold the reinforcing member and tube together. Staples 62 may be spaced apart along the length of the tube and reinforcing member as desired.

Figure 2:
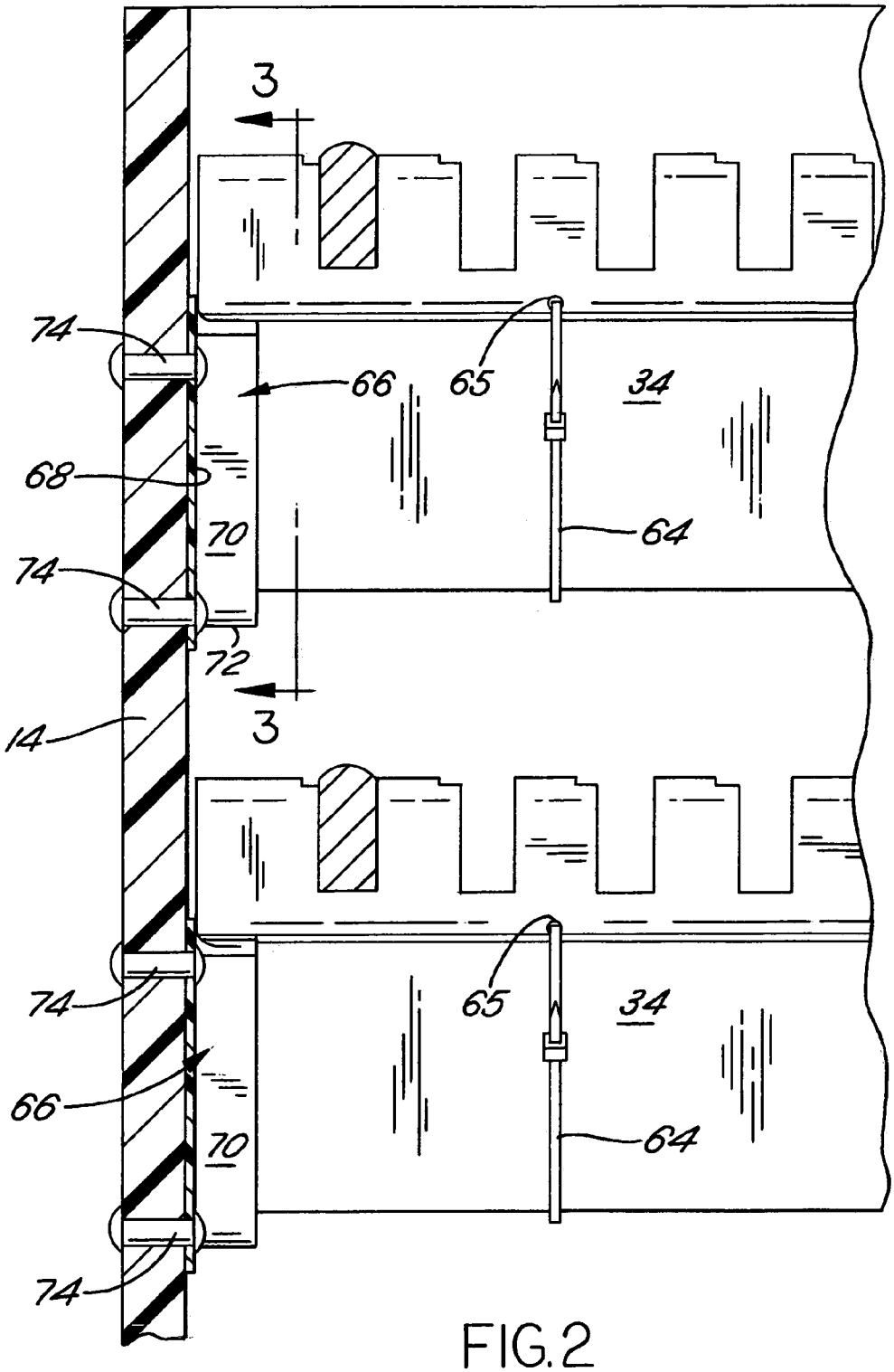
FIG. 2 is a cross-sectional view taken on line 2-2 in FIG. 1 showing two layers of dunnage and product.

In addition to, or in lieu of the staples 62, bag ties 64 may also be used to secure the reinforcing member to the tube and prevent delamination. In the case of bag ties, holes 65 would be provided in the tubes and the bag ties threaded therethrough and around the reinforcing members 34 as shown in FIG. 2. The laminations of the reinforcing member can also be held together by sonic welding.

The ends of the reinforcing members 34 are supported on the side wall 14 of the box 10, and its opposed companion wall not shown, by dunnage supports 66 which may be molded or vacuum-formed of any suitable plastic. Each of the supports comprises a base plate 68 with a V-shaped shoulder 70, the apex 72 of which extends downwardly with the shoulder forming a V-shaped pocket into which the end of the reinforcing member is received. This is best shown in FIGS. 2 and 3. The dunnage supports 66 may be secured to the side wall 14 of the box and the opposite companion wall (not shown) by rivets 74 as shown in FIG. 2. The dunnage supports open upwardly at the ends 76 and 78 of the V-shaped shoulder as best shown in FIG. 3, and the dunnage tubes and associated reinforcing members may be placed in and readily removed from the V-shaped pockets.

If desired, an adhesive layer 80 may be disposed between the side wall 14 of the container and the plate 68 of the dunnage support as shown in FIG. 4.

While we have illustrated the invention in reference to the use of tubular dunnage 40, such as shown in U.S. Pat. No. 5,267,652, it will be understood that the cast or vacuum formed plastic strips illustrated in U.S. Pat. No. 5,178,279 may be similarly used with the reinforcing members 34 whereby the vacuum formed strips are supported throughout their length and ends of the reinforcing members are received in V-shaped or the like pockets in or at the side walls of the containers. Such strips may be secured to the reinforcing members 34 by the use of bag ties, stapling or any other suitable devices.

Figure 6:
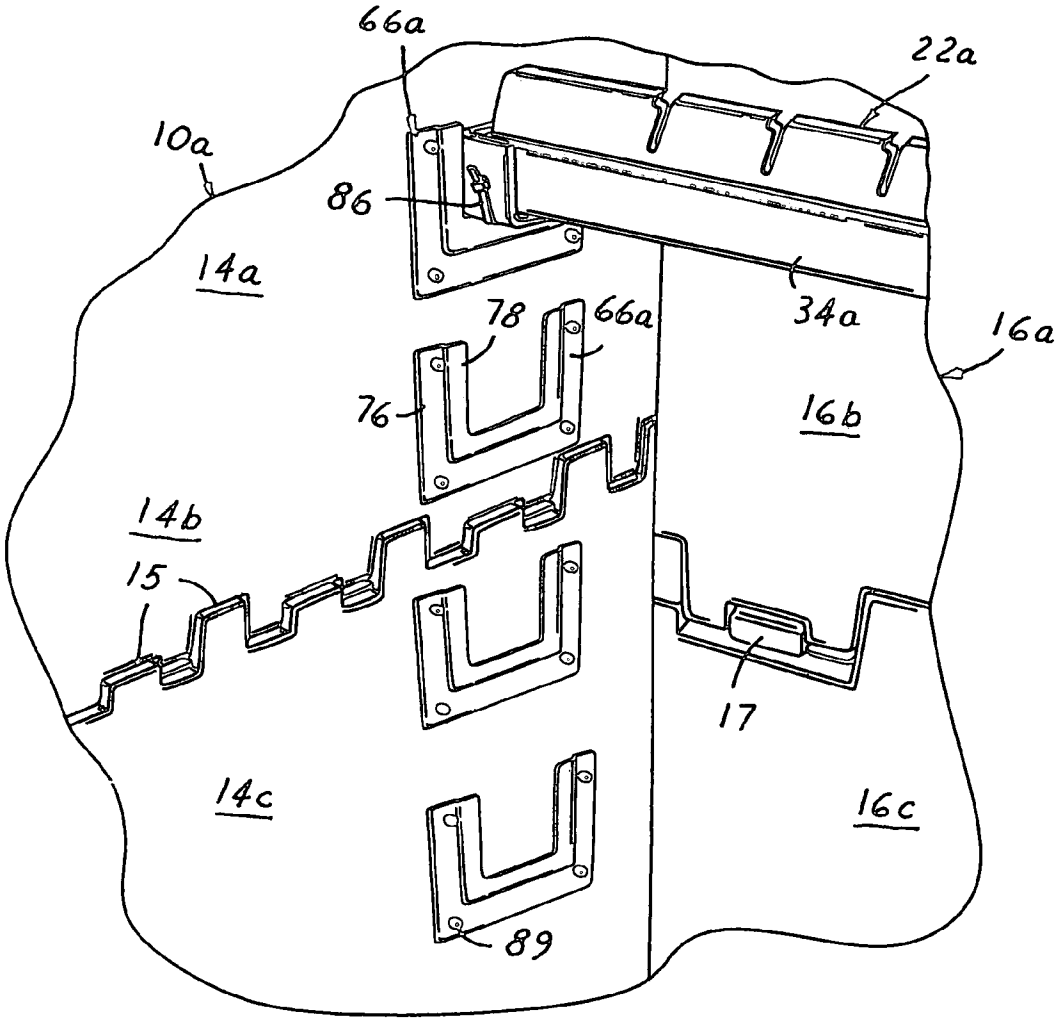
FIG. 6 is an inside corner perspective of a returnable shipping box with the improved dunnage therein.
Figure 8:
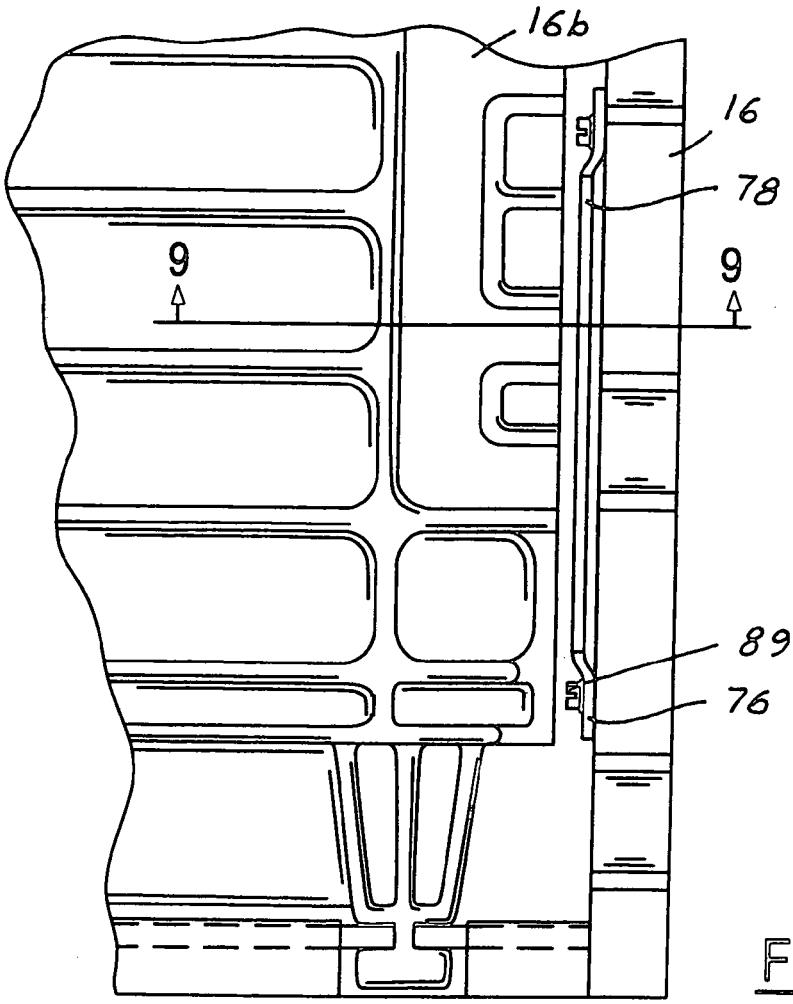
FIG. 8 is a view looking down into a box adjacent a dunnage-supporting bracket and depicting the clearance between a box wall and the bracket permitting the collapsing of the box.
Figure 9:
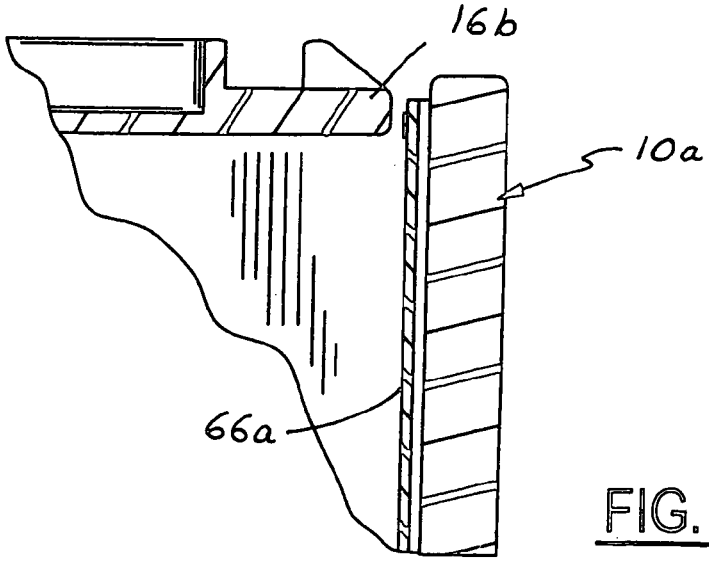
FIG. 9 is a cross-sectional view taken on the line 9-9 of FIG. 8.
Figure 10:
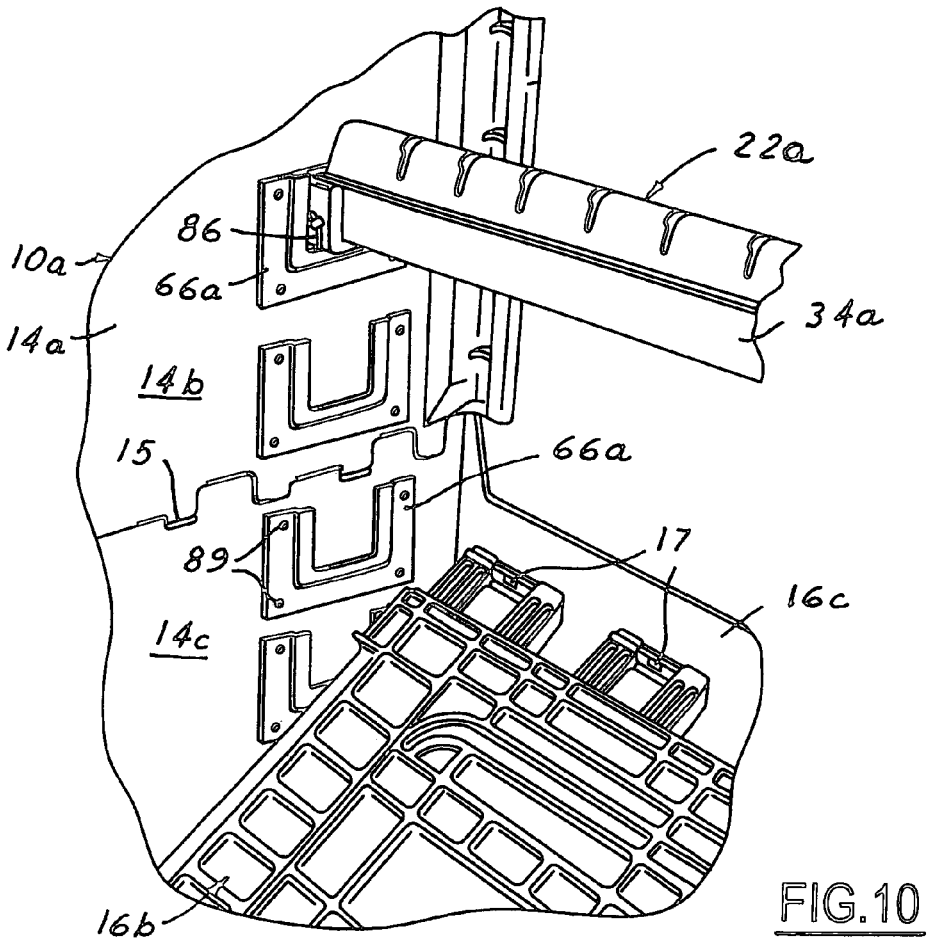
FIG. 10 is a perspective view of the inside corner of a reuseable shipping container utilizing our invention.
Figure 11:
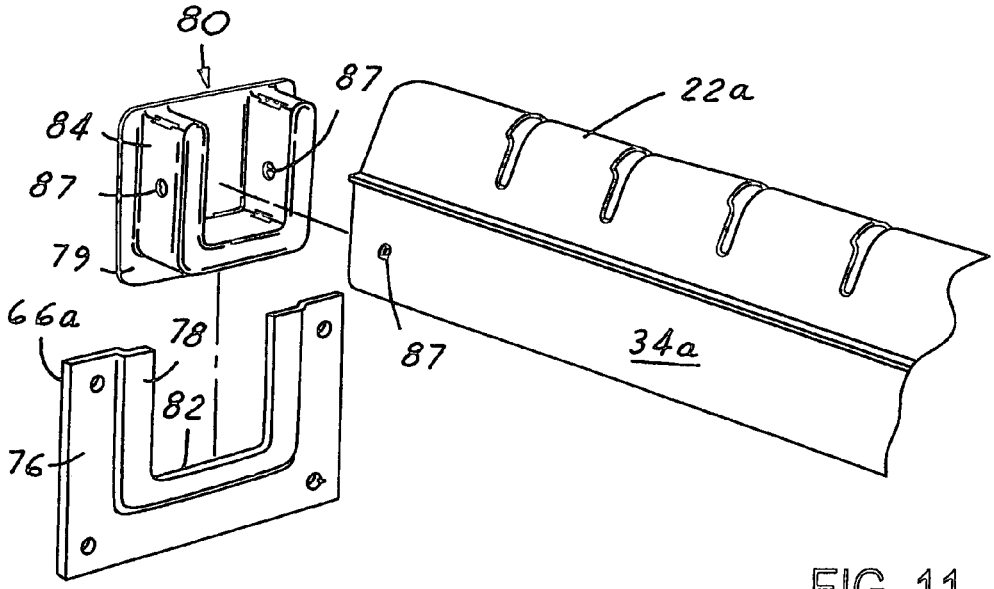
FIG. 11 is a perspective view showing the shape and construction of the interfitting bracket, flange and dunnage tube.

In FIGS. 6-11, inclusive, we disclose modifications of the dunnage enabling its use with collapsible shipping containers or boxes. Such boxes are generally formed of relatively rigid materials and may be formed of plastic castings, metal or other materials that will withstand abuse and protect the parts supported by the dunnage within the boxes during shipment and handling. In FIGS. 6 and 10 we have shown the inside corner of a returnable box 10*a* having a side wall 14*a* composed of a upper foldable portion 14*b* and a lower fixed portion 14*c*. In FIG. 6 an end wall 16*a*, extending between side walls 14*a* (only one of which is shown), has an upper portion 16*b* hinged at 17 to a lower fixed wall portion 16*c*. The upper wall portion is shown upright in FIG. 6, while in FIG. 10, the wall portion 16*b* is swung inwardly between the side wall and over the floor of the box (not shown). Extending transversely of the box between the side wall 14*a* and the opposed complementary wall not shown, is a length of the dunnage 22*a* supported at opposite ends in shallow pockets 66*a* as shown in FIGS. 6 and 10. Normally, a length of dunnage 22*a* would not be in place when an end wall had been folded inwardly over the bottom of the box as in FIG. 10. Thus, FIG. 10 is for illustrative purposes only and does not depict the normal position of the dunnage vis-a-vis the end walls 16 of the box.

The upper portion 14*b* of the side wall is hinged to the lower rigid portion 14*c* at the hinge area 15 whereby the upper portion 14*b* may be folded inwardly of the box to overly the upper portion 16*b* of the end wall which has been folded in over the bottom wall of the box in FIG. 10. The shallow pockets 66*a* permit the end wall portions 16*b* to be folded inwardly and bypass the pockets as best shown in FIGS. 8 and 9. The pockets comprise an outer flange 76 surrounding an outwardly displaced retainer wall 78, which is displaced out of the plane of the flange 76 by only slightly more than the thickness of the material of which the flange 79 of the retainer 80 is formed. In the embodiment shown in FIGS. 6 and 11, there is a U-shaped opening 82 in the retainer wall 78 to accommodate the U-shaped neck 84. The neck is adapted to receive and embrace the end of reinforcing member 34*a* which extends along and beneath the dunnage strip 22*a*. To prevent dislodgement of the neck 80 from the ends of the tubular reinforcing member 34*a*, bag ties 86 or other suitable retainer means may be received through holes 87 in the neck and the reinforcing member. The pockets 66*a* may be secured in any convenient fashion to the walls of the container, such as by the use of screws, stapling or rivets 89 or by adhesive as previously disclosed at 80 in FIG. 4.

Figure 7:
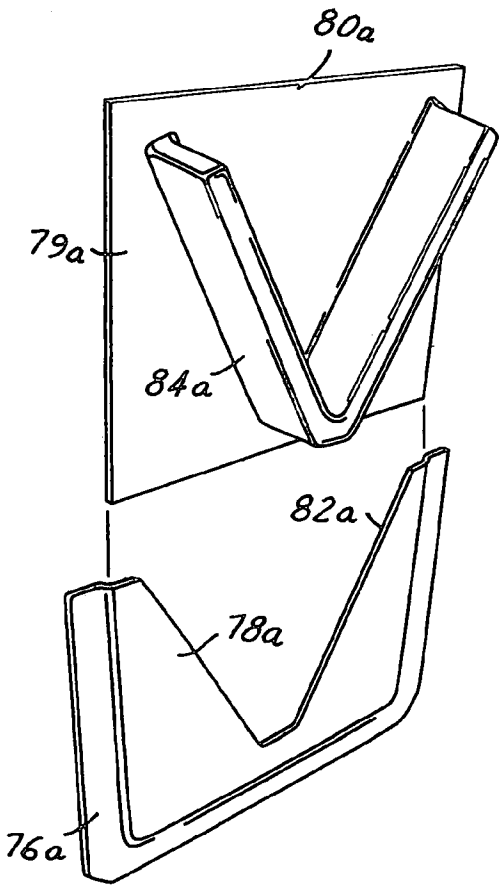
FIG. 7 is a perspective view of a V-shaped pocket and flange member.

The tubular reinforcing members 34*a* are depicted as essentially square, but may be of whatever shape desired to carry the weight of the articles nested in the dunnage. For example, the triangular reinforcing members 34 shown in FIGS. 2 and 3 may be utilized. In this case, the retainer 80*a*, as shown in FIG. 7, is very similar to retainer 80 except for the shape of the shoulder 84*a* adapted to receive the triangular reinforcing tube and the shape of the cut-out 82*a*. Desirably, the pocket 66*a* and the retainer 80 are formed of polyethylene with a thickness of substantially 0.105" such that the depth of the pocket measured perpendicular to the wall 14*b* is approximately a ¼".

In order to facilitate proper orientation of the products to be supported by the dunnage, the necks 80 and the pockets 66*a* on one wall of the container or box may be of one color while the necks and pockets on the opposite wall of the container may be a different color. This will enable the workman to place the dunnage in proper orientation in the box to accommodate the products to be carried thereby.

It will be noted, particularly in FIG. 10, that the height of the fixed lower wall portion 16*c* is sufficient to provide a storage area between the floor of the box and the inwardly folded wall 16*b*. The dimensioning is such that the upper wall portion 14*b* may be folded inwardly over the floor of the box to overlie the inwardly folded wall 16*b*. Beneath such walls, the dunnage may be stored when the box is returned to the sender.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A shipping or storage container and associated dunnage for elongated products arranged in layers comprising, in combination:

a box having four side walls with two of the walls being opposed and spaced apart at least the length of the products to be shipped or stored;

dunnage arranged in layers in the box extending lengthwise between the other two side walls for receiving and supporting the products in layers in the box;

said dunnage comprising elongated resilient plastic strips having product receiving openings within which the products are received for holding the products out of contact with adjacent products;

reinforcing members for the strips extending along the length thereof for preventing sagging thereof;

said reinforcing members comprise elongated relatively rigid tubes; and said other two side walls of the box having dunnage supports adjacent the ends of the reinforcing members for removably receiving and supporting said reinforcing members and associated strips out of contact with superjacent or subjacent layers of products.

2. The dunnage of claim 1 wherein said relatively rigid tubes are rectangular in cross-section and are disposed against the underside of the elongated resilient plastic strips.

3. The dunnage of claim 2 in which fastener means is provided securing the elongated resilient plastic strips to the relatively rigid tubes.

4. Dunnage for use with returnable shipping or storage containers having four opposed side walls which are foldable inwardly over a floor in the container comprising:

elongated dunnage having product receiving openings within which products are received for holding the products out of contact with adjacent products, such elongated dunnage to extend crosswise between a first pair of opposed walls of the container to hold products extending crosswise between the remaining pair of opposed walls of the container;

dunnage supporting brackets for attachment to the said first pair of opposed walls of the container and cooperating with the elongated dunnage to support it in layers in the container; and said supporting brackets being sufficiently shallow to allow the walls of the container to be folded inwardly over the floor of the container between the opposed walls having the brackets mounted thereon.

5. The dunnage of claim 4 wherein said elongated dunnage comprises strips of resilient material having upwardly opening slots for receiving and nesting the products and a reinforcing portion extending along beneath each strip to prevent sagging thereof, and opposite ends of the reinforcing portion having a flange for reception in said supporting brackets for supporting the dunnage on the wall.

6. The dunnage of claim 5 wherein the reinforcing portion comprises a hollow tube of relatively rigid material and said flange has a neck portion interfitting with the end of the tube to support the same when the flange is received in said bracket.

7. The dunnage of claim 6 wherein the hollow tube is of rectangular cross-section, and said neck portion has a shoulder with flat faces to cooperate with the tube to prevent any appreciable rotation between the flange and the tube.

8. The dunnage of claim 4 wherein the said brackets and the ends of the dunnage are color-coded whereby the dunnage may be placed in the container in a predetermined orientation.

9. The dunnage of claim 5 wherein said flanges and brackets are color-coded whereby the dunnage may be placed in the box in a predetermined orientation.

10. The dunnage of claim 4 wherein said brackets project inwardly of the box to provide a space between the bracket and the container wall forming a pocket, and the ends of the dunnage having flanges receivable in such pockets to support the dunnage on the container walls.

11. A returnable shipping container and associated dunnage for elongated products arranged in layers comprising, in combination:

a box having a floor, two opposed side walls and two opposed end walls, with such walls being foldable inwardly over the floor to reduce the height of the box for return shipping;

elongated dunnage to be arranged in layers in the box and extending crosswise thereof between the opposed side walls and extending generally parallel to the two end walls;

said opposed side walls having dunnage receiving and supporting brackets thereon arranged in opposed pairs on such opposed side walls for receiving the ends of such dunnage extending crosswise of the box between such side walls; and said dunnage receiving and supporting brackets projecting inwardly of the box to receive and support the ends of the dunnage but not sufficiently to prevent the end walls from being folded inwardly between the side walls to overlie said floor.

12. The returnable shipping container and associated dunnage of claim 11 wherein said walls have swingably connected upper and lower portions with the lower portion being fixed and the upper portion being swingable inwardly over said floor;

said fixed portion of at least some of said walls being hinged to the upper wall portion sufficiently high above the floor as to create storage space for dunnage between its inwardly swinging upper wall portion and the floor when the box is to be returned thereby reducing the height of the box for return shipment after emptying; and all dunnage for said box being receivable in said stowage space for return shipment with the box.

* * * * *